US009706834B1

(12) United States Patent
Taylor

(10) Patent No.: US 9,706,834 B1
(45) Date of Patent: Jul. 18, 2017

(54) INTEGRATED BEACH UMBRELLA AND TABLE SYSTEM

(71) Applicant: Mark Taylor, Gilbert, AZ (US)

(72) Inventor: Mark Taylor, Gilbert, AZ (US)

( * ) Notice: Subject to any disclaimer, the term of this patent is extended or adjusted under 35 U.S.C. 154(b) by 0 days.

(21) Appl. No.: 15/201,776

(22) Filed: Jul. 5, 2016

Related U.S. Application Data

(60) Provisional application No. 62/390,974, filed on Apr. 15, 2016.

(51) Int. Cl.

| | |
|---|---|
| ***A47B 37/04*** | (2006.01) |
| ***A45B 23/00*** | (2006.01) |
| *A45B 25/00* | (2006.01) |
| *A47B 3/00* | (2006.01) |

(52) U.S. Cl.
CPC ..... *A47B 37/04* (2013.01); *A45B 23/00* (2013.01); *A45B 2023/0012* (2013.01); *A45B 2025/003* (2013.01); *A45B 2200/1027* (2013.01); *A45B 2200/1063* (2013.01); *A47B 2003/004* (2013.01)

(58) Field of Classification Search
CPC ..... A47B 37/04; A45B 2200/1063
See application file for complete search history.

(56) References Cited

U.S. PATENT DOCUMENTS 2,039,805 A * 5/1936 Knight ..... A47B 37/04 108/128
2,454,202 A * 11/1948 Pierik ..... A47B 3/08 108/173
4,584,946 A * 4/1986 Tucker ..... A47B 37/04 108/128
4,920,897 A * 5/1990 Reed ..... E04H 12/2223 108/150
5,197,394 A * 3/1993 Schmidt ..... A45B 23/00 108/128
6,487,977 B1 * 12/2002 Williams ..... A45B 23/00 108/150
7,007,703 B2 * 3/2006 Brooks, III. ..... A45B 3/00 135/16
7,207,450 B1 * 4/2007 Franklin ..... A45F 3/44 108/25
7,520,485 B1 * 4/2009 Giannetto ..... A01K 97/10 173/91
8,317,355 B1 * 11/2012 Wang ..... A45B 3/02 362/102
2002/0036008 A1 * 3/2002 Hickam ..... A47B 37/04 135/98

(Continued)

FOREIGN PATENT DOCUMENTS

GB 2227653 A * 8/1990 ..... A47B 37/04

*Primary Examiner* — Noah Chandler Hawk
(74) *Attorney, Agent, or Firm* — Iussa Law, PLLC

(57) ABSTRACT

Disclosed is an integrated beach umbrella and table system that includes a support post, wherein an umbrella support frame couples to the support post and is expandable and collapsible about the support post, and an umbrella canopy couples to the umbrella support frame. The system further includes a table surface support frame assembled from a plurality of armature elements that couple to an anchor hub and a central hub, wherein at least one of the anchor hub and the central hub slidably engages to the support post. The anchor hub and the central hub slide to produce a first expanded position and a second collapsed position of a table surface coupled to the table surface support frame.

16 Claims, 7 Drawing Sheets

(56) References Cited

U.S. PATENT DOCUMENTS

| | | | | |
|---|---|---|---|---|
| 2004/0129184 | A1* | 7/2004 | Kraker | A45B 25/00<br>108/50.12 |
| 2007/0246091 | A1* | 10/2007 | Becker | A45B 3/00<br>135/16 |
| 2009/0058354 | A1* | 3/2009 | Harrison | A45B 3/00<br>320/101 |
| 2010/0163086 | A1* | 7/2010 | Chavez | A45B 3/00<br>135/16 |
| 2010/0180922 | A1* | 7/2010 | McKenna | A45B 25/18<br>135/96 |

* cited by examiner

660 Assembling a complimentary plurality of second armature elements.

762 Pivotally affixing a second armature first end to the anchor hub.

764 Affixing a second armature second end at a point along a length of its complimentary first armature element.

635 Providing the table surface.

770 Providing a fabric type material.

772 Coupling the first armature second end of each of the plurality of first armature elements to a perimeter portion of the table surface

FIG. 7

INTEGRATED BEACH UMBRELLA AND TABLE SYSTEM

CROSS-REFERENCE TO RELATED APPLICATIONS

This disclosure claims priority to U.S. provisional patent application 62/390,974 filed Apr. 15, 2016; the entire contents of which are hereby incorporated by reference.

TECHNICAL FIELD

This disclosure relates generally to accessories for a beach goer, and relates more particularly to a portable, compact, and integrated beach umbrella and table system.

BACKGROUND

Outdoor enthusiasts, such as beach goers, enjoy the advantages of various ancillary items to enhance their beach going experience, such as beach umbrellas, beach towels, pails, shovels, floatation devices, surf-riding instruments, radios, coolers, etc. One item to enhance their experience even greater is a portable, compact table, designed specifically for beach goers so that they may place various items at an elevated position, away from the beach sand's surface. Beach tables, however, are often considered a superfluous item, and because of the numerous other items a beach goer already must trek to the beach, the beach goer may decide not to bring the item. Instead, beach goers will merely place their items on a towel, precariously in the sand, or rely on other items not designed for use as a "table." For example, beach goers may rely on a cooler's surface to place items away from the sand's surface, but this inhibits the ability to regularly access the cooler. i.e. everything must be removed from atop the It is an object of the exemplary embodiments described herein to disclose a compact, portable, integrated beach umbrella and table system that when in a stowed (collapsed) position, the system is in a compact form to allow for easy storage and/or travel.

It is a further object of the invention to provide for a table system that is configured to be integrated with a patio-style type umbrella. Since such umbrellas are used for general use, cook-outs, Bar-b-ques, pool parties, and the like where food and beverages are common place, users may benefit, whether the setting is personal residential, or a commercial restaurant, resort, hotel, etc.

SUMMARY

In general, an exemplary embodiment of an integrated beach umbrella and table system comprises; a support post, a collapsible umbrella coupled to the support post, and a collapsible table also coupled to the support post.

In an exemplary embodiment, an integrated beach umbrella and table system comprises a support post whereon an umbrella support frame couples to the support post and is configured to expand and collapse about the support post. An umbrella canopy is configured to couple to the umbrella support frame. The system further comprises a table surface support frame, wherein the table surface support frame comprises a plurality of armature elements that, in one configuration, couple to an anchor hub and a central hub. The anchor hub and the central hub engages the support post and couples to at least a portion of the plurality of armature elements, wherein at least one or both of the anchor hub and the central hub slides to produce a first expanded position and a second collapsed position of the plurality of armature elements. A table surface generally comprises a fabric-type material and couples to the table surface support frame.

Among exemplary embodiments, the table surface support frame comprises a plurality of armature elements, wherein the plurality of armature elements comprises; a plurality of first armature elements, and a complimentary plurality of second armature elements. Each of the plurality of first armature elements comprises a first armature first end pivotally coupled to the central hub; each of the plurality of second armature elements comprises a second armature first end pivotally coupled to the anchor hub, and a second armature second end pivotally couples to a point positioned along a length of its complimentary first armature element.

Among the exemplary embodiments, when the table surface support frame is in the first expanded position, a first armature second end of each of the plurality of first armature elements is substantially co-planar with the central hub, and in an exemplary embodiment, couples to a perimeter portion of the table surface.

The various exemplary embodiments may comprise some, all, or none of the following. An embodiment may comprise one end of the support post to comprise a helical configuration to facilitate auguring the support post into a surface so as to maintain the support post in a substantially upright position. Embodiments may also comprise; a channel that extends longitudinally along the support post, and a key-type portion that protrudes inwardly from an inner diameter of at least one of the anchor hub and the central hub to interface with the channel. The key-type portion is configured to fit within the channel of the support post to inhibit torsional rotation of at least one of the anchor hub and central hub about the support post. In some embodiments; each of the plurality of first armature elements further comprise telescopic portions that are expandable to accommodate varying sizes of table surfaces, the support post may comprise a pivoting mechanism between the collapsible umbrella and the collapsible table to facilitate tilting the collapsible umbrella, and/or the collapsible table may be rotatable about the support post.

Exemplary embodiments of the system may comprise various novelty elements. For example, embodiments may comprise the table surface to comprise various cup holders and storage bins, pockets, sleeves, etc. Moreover, the support post of the system may be separable, wherein the support post separates into a support post first section and a support post second section. In an embodiment the support post first section supports the umbrella support frame, and the support post second section supports the table surface support frame. In still yet another embodiment the system may comprise an electronic device support frame to support at least one of a smartphone, tablet, and video display, and in association with such device support frame, the umbrella canopy may comprise solar cell elements to convert sunlight to a useable electrical current, wherein the useable electrical current is transmitted via a suitable conduit to the electronic device support frame to provide electrical power for the at least one of the smartphone, table, and video display.

BRIEF DESCRIPTION OF THE DRAWINGS

FIGS. 6 and 7 depict a method flow chart for a method of manufacturing an exemplary embodiment of an integrated beach umbrella and table system.

A more complete understanding may be derived by referring to the detailed description and claims when considered in connection with the above illustrative FIGS. In the FIGS., the same reference numbers refer to the same elements and steps throughout the FIGS.

Elements and steps in the FIGS. are illustrated for simplicity and clarity and are not necessarily rendered according to any particular sequence. For example, steps that may be performed concurrently or in different order are illustrated in the FIGS. to help to improve understanding of exemplary embodiments.

For simplicity and clarity of illustration, the FIGS. illustrate the general manner of construction, however, descriptions and details of well-known features and techniques can be omitted to avoid unnecessarily obscuring integrated beach umbrella and table systems and their methods of manufacture. Additionally, elements in the FIGS. are not necessarily drawn to scale. For example, any illustrative dimensions of elements in the FIGS. can and may be exaggerated relative to other elements to help improve the understanding of embodiments of integrated beach umbrella and table systems and their methods of manufacture.

DETAILED DESCRIPTION

Exemplary embodiments described herein may be described in terms of functional block components and various processing steps. Such functional blocks may be realized by any number of hardware components configured to perform the specified functions and to achieve various results. For example, integrated beach umbrella and table systems may employ various frames and/or beach umbrella and table supports and table surface components, e.g., tubular structures and/or solid support elements, hinges, pins, clips, fittings, support posts, canopies, canopy/table fabrics and the like, which may carry out a variety of functions. In addition, the integrated beach umbrella and table systems may be practiced in conjunction with any number of settings, such as for beach going, general camping, travel, residential/commercial use, etc.

Also, any systems and/or methods described are merely exemplary applications for the integrated beach umbrella and table systems, and the integrated beach umbrella and table systems may employ any number of conventional techniques for manufacturing, distributing, marketing, packaging, shipping, selling, and the like.

Figure 1:
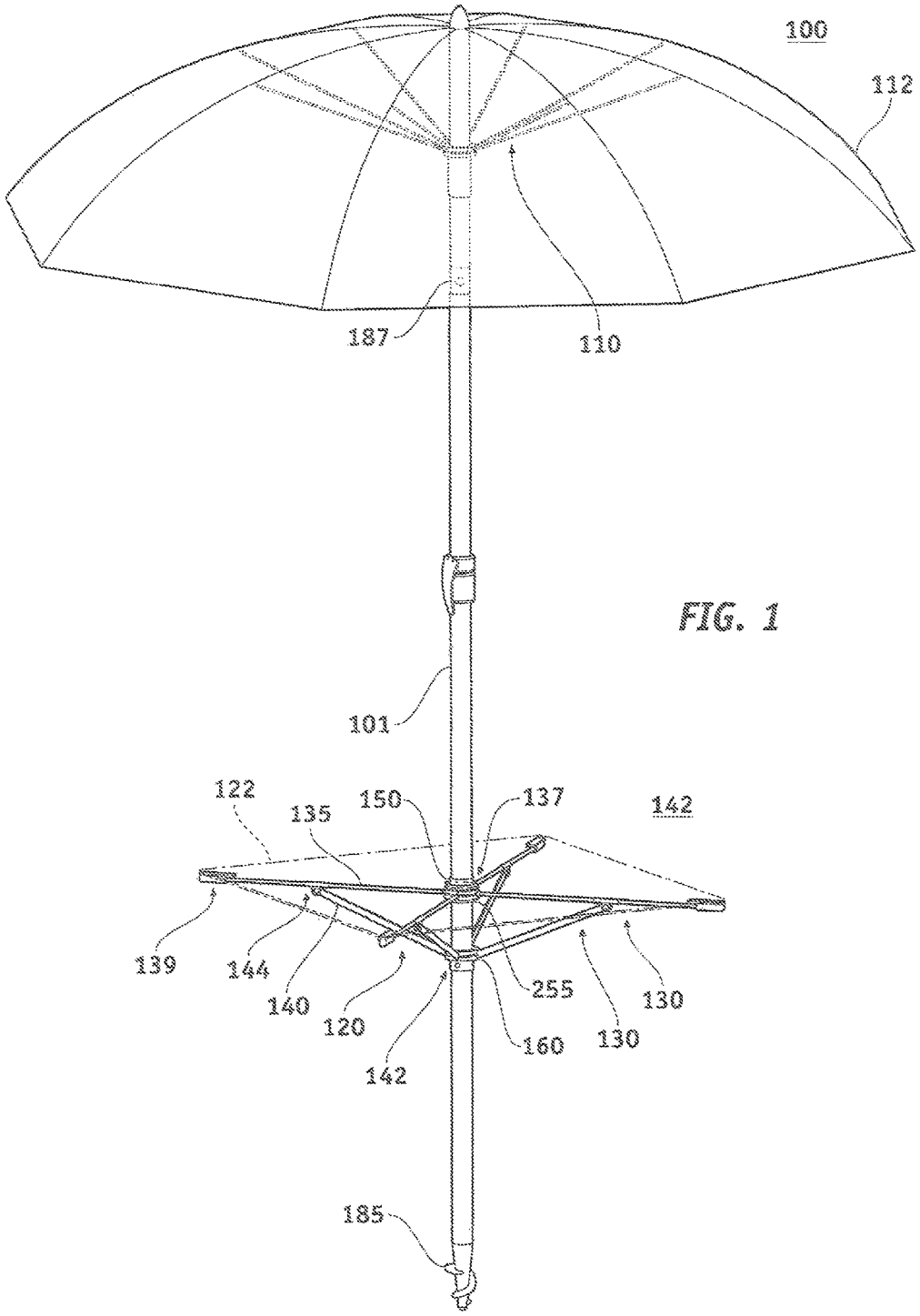
FIG. 1 depicts an exemplary embodiment of an integrated beach umbrella and table system in a substantially first expanded position.
Figure 2:
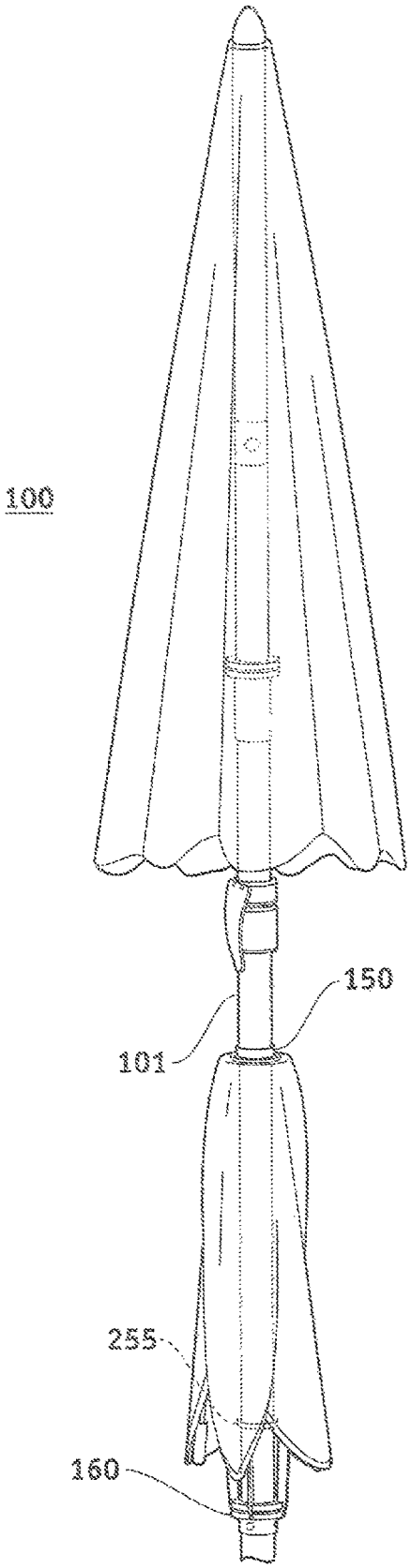
FIG. 2 depicts an exemplary embodiment of the integrated beach umbrella and table system in a substantially second collapsed position.

Various exemplary embodiments may be applied to any system or method to produce any beach umbrella and table system. Turning now to the FIGS., FIGS. 1 and 2 depict an integrated beach umbrella and table system 100 comprising; a support post 101, an umbrella support frame 110 coupled to support post 101 and configured to expand and collapse about support post 101, and a table surface support frame 120 similarly coupled to support post 101 and configured to expand and collapse about support post 101. System 100 further comprises; an umbrella canopy 112 configured to couple to umbrella support frame 110, and a table surface 122 configured to couple to table surface support frame 120.

Among various exemplary embodiments, table surface support frame 120 comprises a plurality of armature elements 130 wherein the plurality of armature elements 130 comprises a plurality of first armature elements 135, and a complimentary plurality of second armature elements 140. It will be appreciated by those skilled in the art that for most embodiments, the term "complimentary" defines that, for each of the plurality of first armature elements, there is a corresponding second armature element associated with it. It will be further appreciated by those skilled in the art that while the preferred embodiment disclosed herein describes first and second armature elements suitably coupled together to form the table surface support frame, other armature configurations comprising additional or fewer armature configurations are contemplated by this disclosure. Moreover, while the plurality of armature elements disclosed herein are discussed in relation to coupling to an anchor hub and central hub, other coupling configuration may be employed. For example, armature elements may couple directly to the support post; other armature actuation and/or securing mechanisms, such as levers, pulleys, ropes, tabs, springs, and the like. Those skilled in the art will further appreciate that while this disclosure describes primarily an integrated table in conjunction with a beach umbrella, an integrated table may be employed by any umbrella system, for example, residential or commercial patio-style type umbrellas. Moreover, an integrated table is not limited to be incorporated solely with various umbrella systems, but rather may be employed by any support structure comprising a support post that the collapsible/expandable integrated table may couple to, for example, portable canopy structures, fence posts, and any other tubular elements.

Continuing with a preferred embodiment, each of the plurality of first armature elements 135 comprises a first armature first end 137 that pivotally couples to a central hub 150. Each of the plurality of second armature elements 140 comprises a second armature first end 142 that pivotally couples to an anchor hub 160, and each of the plurality of second armature elements 140 comprises a second armature second end 144 that pivotally couples at a point along a length of its complimentary first armature element 135.

In an exemplary embodiment, anchor hub 160 and central hub 150 engage a lower portion of support post 101 and below umbrella support frame 110, and in one embodiment the positioning of the hubs along support post 101 may be adjustable so that table surface support frame 120 may be employed by a user at various table setting heights. At least one or both of anchor hub 160 and central hub 150 may slidably engage with support post 101, wherein either one or both of anchor hub 160 and central hub 150 slides to produce a first expanded position, as depicted by FIG. 1, and a second collapsed position, as depicted by FIG. 2, for table surface 122. In the first expanded position, a first armature second end 139 of each of the plurality of first armature elements 135 is substantially co-planar with central hub 150, and in most embodiments couples proximate or directly to a perimeter portion of table surface 122, best seen by reference to FIG. 4. Among some embodiments, system 100 may comprise hub stop 255, FIG. 2. Hub stop 255 is affixed at a point along support post 101 and between central hub 150 and anchor hub 160. As either one or both of central hub 150 and/or anchor hub 160 is slid along support post 101 to provide for the first expanded position, hub stop 255 operates as a barrier stop to either hub to prevent over-actuation of table surface support frame 120. Those skilled in the art will appreciate that hub stop 255 is strategically positioned upon support post 101 to aide in maintaining the first expanded position of table surface support frame so that any table surface comprises a substantially planar configuration for operating as a useable table surface.

With continued reference to FIGS. 1 and 2, support post 101 may comprise a tubular element such as that made from aluminum to provide a lightweight yet strong central support for system 100, however, any other material, such as wood, metals, alloys, plastics, composites and the like may be employed to operate as support post 101. In other exemplary embodiments, and to provide for a compact nature of system 100, i.e. for travel and/or storage, support post 101 may comprise of various sectional portions (not shown) that may be disassembled and subsequently reassembled. The various sectional components may secure together to form the assembled support post 101 by any securing/release mechanism, for example, frictional fits, pins, nested telescoping sections, and the like. In alternative embodiments, and to further facilitate the compact nature of system 100 for travel and/or storage, support post 101 may alternately comprise a collapsible, e.g., telescopic configuration or a foldable configuration. In a preferred embodiment support post 101 may separate into a support post first section and a support post second section, wherein the support post first section supports the umbrella support frame and canopy, and the support post second section supports the table surface support frame and table surface. Moreover, any other mechanism and/or method now known or developed in the future that can operate as a support post in a similar manner as support post 101 and configured to be compact for storage and/or travel, may be used.

Figure 3:
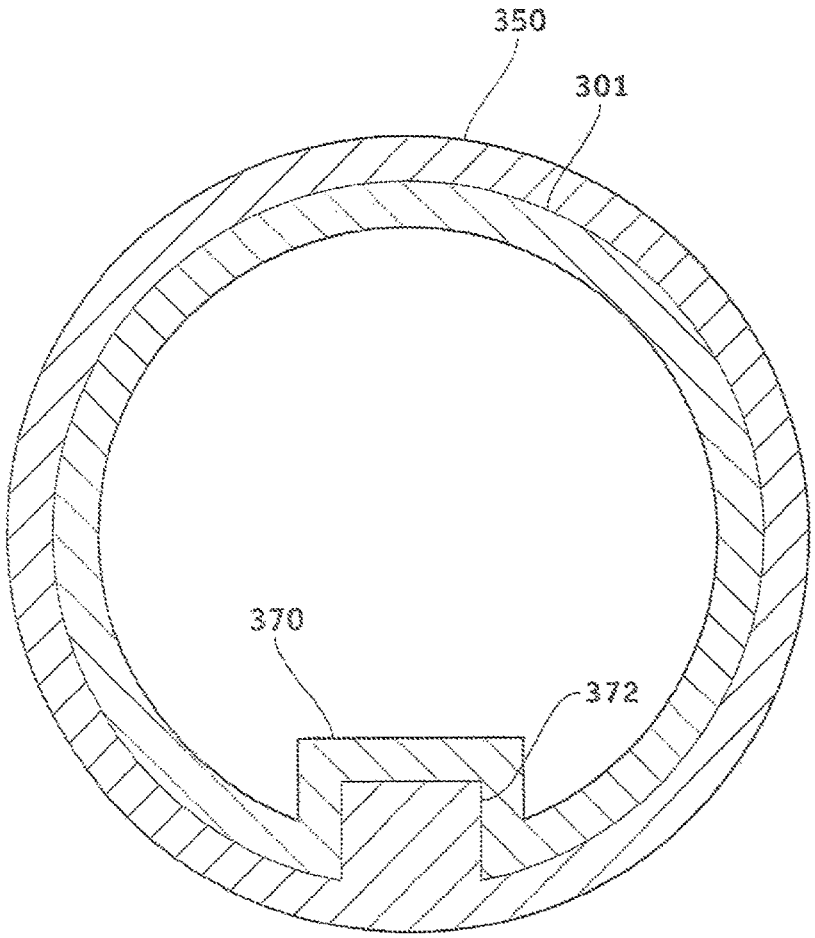
FIG. 3 depicts an exemplary embodiment of a transverse cross-section of a support post and a central hub depicting an inter-facing key and channel configuration.

In accordance with an exemplary embodiment and with reference to FIG. 3, a support post 301, similar to support post 101, may further comprise a channel that extends longitudinally along at least a portion of support post 301. In such an exemplary embodiment, a channel 370 may engage a key-type portion 372 as part of a central hub 350. Such configuration may be similarly comprised by anchor hub 160, as well as a hub portion associated with umbrella support frame 110. By the channel 370 engaging key-type portion 372 of central hub 350 (or 150), anchor hub 160, or that of umbrella support frame 110, the various hubs may be inhibited from any torsional rotation about support post 301, as well as when anchor hub 160, central hub 350 or that of umbrella support frame 110 slidably engages support post 301 along its length. It should be appreciated by those skilled in the art, however, that a variety of configurations of support post 301 and any of the various hubs may be used to inhibit any torsional rotation of the various hubs about support post 301. In another exemplary embodiment, support post 301, instead of comprising a female channel portion, may comprise of a male spline element that runs longitudinally along the length of support post 301, and any of the various hubs may comprise of a female recessed portion to accept the spline element. In yet another exemplary embodiment, support post 301 and any of the various hubs may comprise of more than one channel/key configuration, for example, two, three, four or any plurality of channels and keys may be used.

Figure 4:
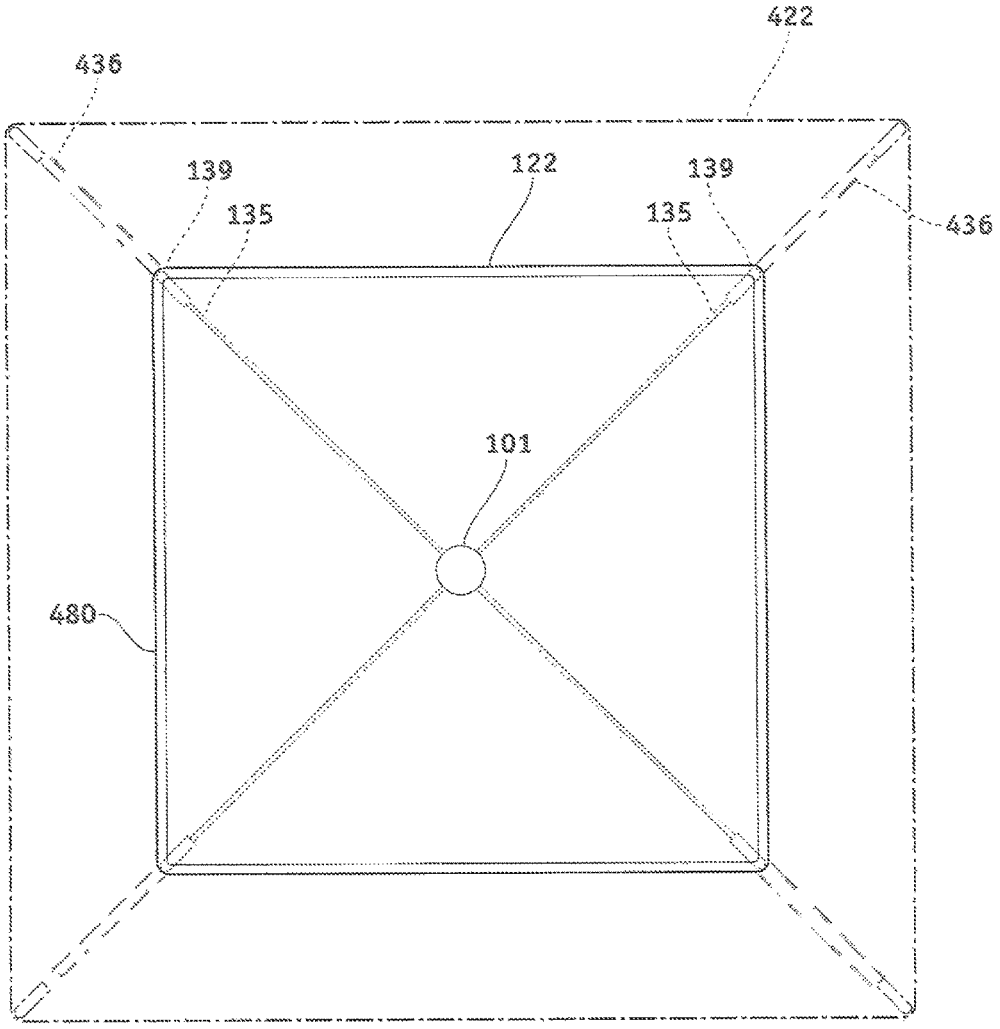
FIG. 4 depicts a top down view of an exemplary embodiment of a table surface and armature elements comprising telescopic elements to support a table surface of a different size.

In accordance with an exemplary embodiment and with reference to FIG. 4, each of the plurality of first armature elements 135 may comprise a first armature telescopic portion 436. In an exemplary embodiment, first armature telescopic portion 436 may extend and retract from within each of the plurality of first armature elements 135, and as such may be configurable to couple to table surfaces of varying sizes. For example, and explained briefly above, first armature elements 135 couples via first armature second ends 139 to a perimeter portion, such as perimeter portion 480, to table surface 122. However, by extending first armature telescopic portions 436, a larger table surface, such as table surface 422, may be supported.

In accordance with an exemplary embodiment, integrated beach umbrella and table system 100 comprises umbrella canopy 112 and table surface 122. Umbrella canopy 112 and table surface 122 may comprise any material that may be coupled and/or secured to their respective plurality of armature elements and/or support post 101. Umbrella canopy 112 and table surface 122 may comprise any variety of materials, either natural or synthetic.

In accordance with various exemplary embodiments and with return reference to FIG. 1, integrated beach umbrella and table system 100 may comprise one end 185 of support post 101 to comprise a helical configuration to facilitate auguring support post 101 into a surface to maintain support post 101 in a substantially upright position. System 100 alternately or additionally may comprise support post 101 to comprise a pivoting mechanism 187 of the type generally known in the art, between the umbrella portion and the table portion so as to facilitate tilting the umbrella. Moreover, some integrated beach umbrella and table systems may comprise a table that is rotatable about support post 101. It will be further appreciated by those skilled in the art that other table configurations may be employed. For example, instead of a table that completely surrounds support post 101, a table that only encircles a portion of support post 101 may be employed, and tables may comprise of various regular and/or irregular geometric configurations, such as square, round, hexagonal, pentagon, etc. In other embodiments, the plurality of armature elements, rather than being actuated into the first expanded position by slidable hubs, may comprise of folding/un-folding armature elements, clip-on tabs elements, etc.

Figure 5:
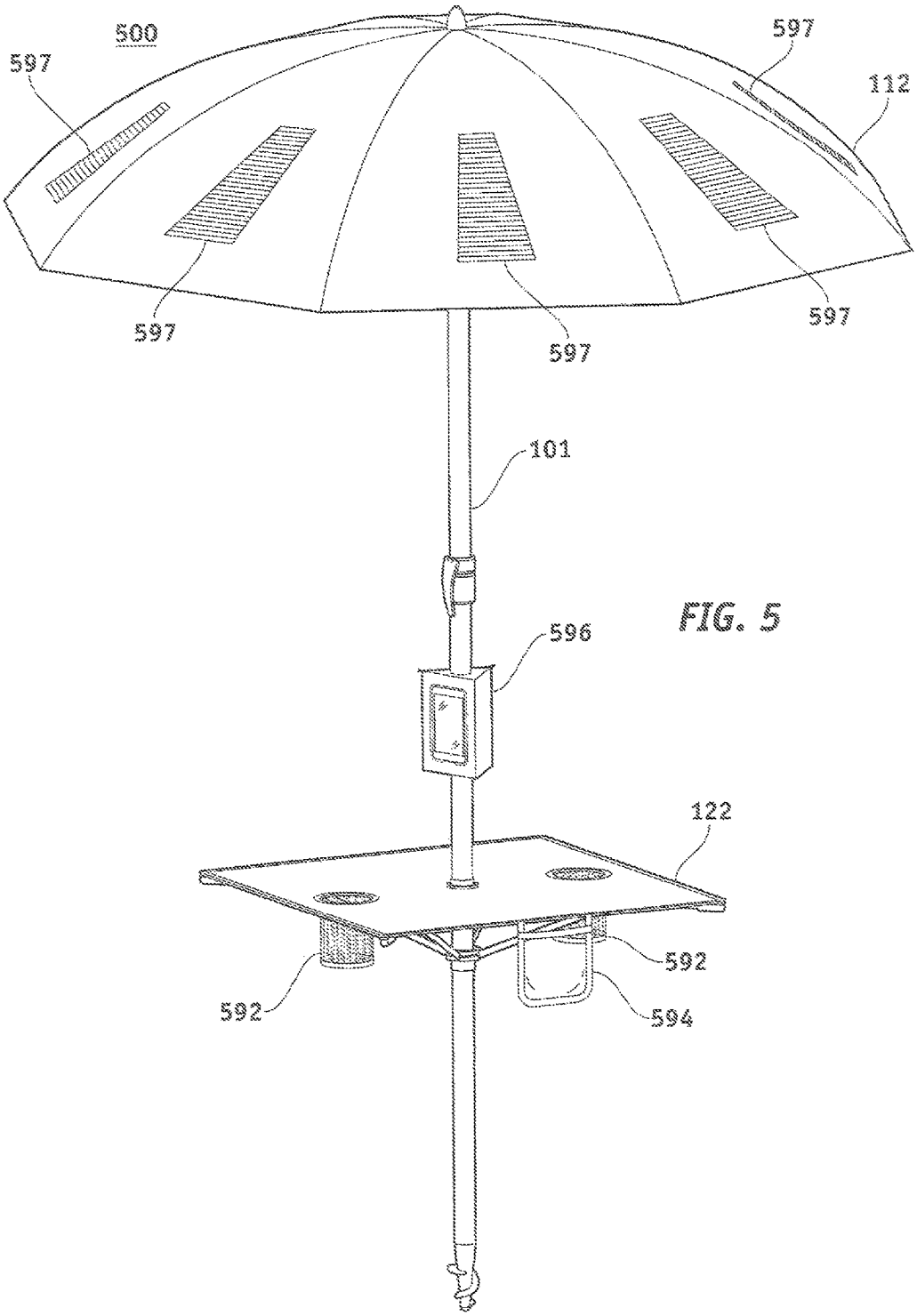
FIG. 5 depicts an exemplary embodiment of an integrated beach umbrella and table system comprising various novelty features.

In accordance with various exemplar embodiments and with reference to FIG. 5, an integrated beach umbrella and table system 500 may comprise various novelty features to accessorize system 500. For example, table surface 122, may comprise integrated cup holders, such as cup holder 592. Table surface 122 may also comprise various storage elements, such as storage bin 594. Support post 101, or other parts of the system, may comprise an electronic device support frame, or similar element, to support an electronic device such as a smart phone, tablet, video display, etc., such as depicted by electronic device support frame 596. In one unique feature, umbrella canopy 122 may comprise solar cell elements 597 to convert sunlight to a useable electrical current, and wherein the useable electrical current is transmitted via a suitable conduit to electronic device support frame 596 so as to provide electrical power for a smartphone, table, video display, etc.

Figure 6:
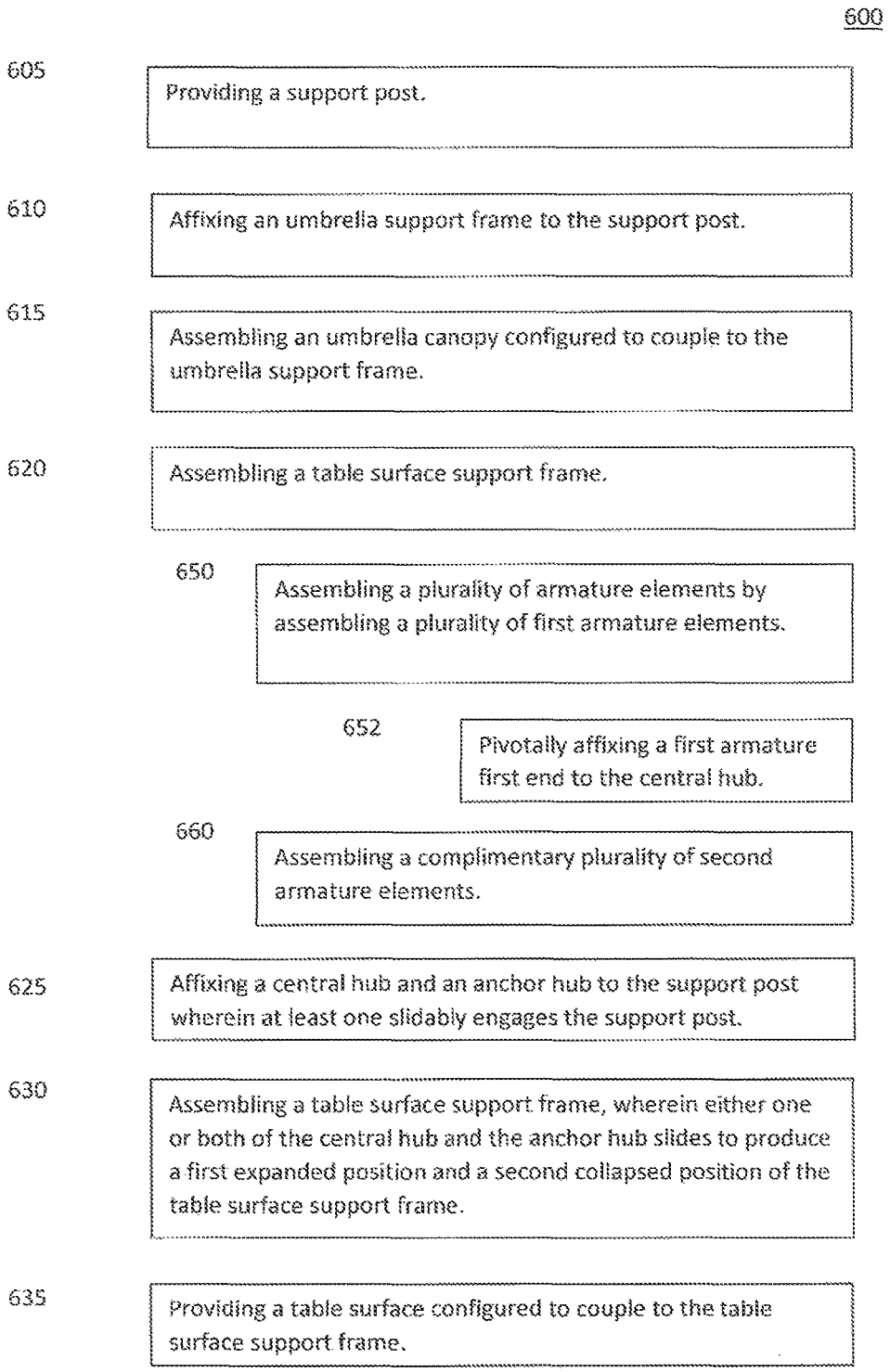

In accordance with an exemplary embodiment of an integrated beach umbrella and table system and its method of manufacture, and turning now to FIGS. 6 and 7, an exemplary method 600 for manufacturing a beach umbrella and table system may comprise: providing a support post (605); affixing an umbrella support frame to the support post (610); assembling an umbrella canopy configured to couple to the umbrella support frame (615); assembling a table surface support frame (620); affixing a central hub and an anchor hub to the support post wherein at least one slidably engages the support post (625) and coupling them to at least a portion of the table surface support frame (630), wherein either one or both of the central hub and the anchor hub slides to produce a first expanded position and a second collapsed position of the table surface support frame. Method 600 further comprises providing a table surface (635) configured to couple to the table surface support frame.

The method (620), wherein assembling the table surface support frame comprises; assembling a plurality of armature elements by assembling a plurality of first armature elements (650), and assembling a complimentary plurality of second armature elements (660).

Assembling the plurality of first armature elements (650) comprises pivotally affixing a first armature first end to the central hub (652), wherein the central hub is affixed proximate a lower portion of the support post that is below the umbrella support frame. With reference to FIG. 7, assembling the complimentary plurality of second armature elements (660) comprises; pivotally affixing a second armature first end to the anchor hub (762), and affixing a second armature second end at a point along a length of its complimentary first armature element (764). Those skilled in the art will appreciate that in the first expanded position, a first armature second end of each of the plurality of first armature elements is substantially co-planar with the central hub.

The method (635), wherein providing the table surface comprises; providing a fabric type material (770), and coupling the first armature second end of each of the plurality of first armature elements to a perimeter portion of the table surface (772).

Among the methods described herein, the methods may further comprise; forming a channel that extends longitudinally along the support post, and incorporating a key that protrudes inwardly from an inner diameter of the central hub. The key is configured to fit within the channel of the support post to inhibit torsional rotation of the central hub about the support post.

Exemplary methods may also comprise assembling each of the plurality of first armature elements to further comprise assembling a first armature telescopic portion that may be expandable to accommodate varying sizes of table surfaces.

The methods of manufacture may also comprise providing one end of the support post to comprise a helical configuration to facilitate augering the support post into a surface to maintain the support post in a substantially upright position. The methods of manufacture may comprise providing the support post to comprise a pivoting mechanism between the collapsible umbrella and the collapsible table to facilitate tilting the collapsible umbrella, and some methods may comprise providing the collapsible table that is rotatable about the support post. The methods of manufacture may also provide for integrated cup holders, storage bins, electronic device support frames, integrated solar power supply and distribution elements, and any other relevant accessories now known, developed in the future, or well known to those skilled in the art.

Among the exemplary methods described herein, and although a particular order of actions is illustrated in FIGS. 6 and 7, these actions can be performed in other temporal sequences. Moreover, the method actions depicted in FIGS. 6 and 7 can be performed sequentially, concurrently, or simultaneously so as to provide for an integrated beach umbrella and table system as described herein, for example, the beach umbrella and table system 100 as shown in FIGS. 1 and 2, the telescopic armature elements and table surfaces as shown in FIG. 4, and/or the beach umbrella and table system 500 as shown in FIG. 5.

In the foregoing specification, integrated beach umbrella and table systems have been described with reference to specific exemplary embodiments. Various modifications and changes may be made, however, without departing from the scope of the integrated beach umbrella and table system as set forth in the claims. The detailed description and FIGS. are illustrative, rather than restrictive, and modifications are intended to be included within the scope of the various exemplary embodiments. Accordingly, the scope of the exemplary embodiments should be determined by the claims and their legal equivalents, rather than by merely the examples described.

For example, the steps recited in any method or process claims may be executed in any order and are not limited to the specific order presented in the claims. Additionally, the components and/or elements recited in any article, system, apparatus and/or device claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required, or essential features or components of any or all the claims.

As used herein, the terms "comprise", "comprises", "comprising", "having", "including", "includes" "is" or any variation thereof, are intended to reference a non-exclusive inclusion, such that a process, method, article, system, device, composition or apparatus that comprises a list of elements does not include only those elements recited, but may also include other elements not expressly listed or inherent to such process, method, article, system, device, composition or apparatus. Other combinations and/or modifications of the above-described structures, arrangements, applications, proportions, elements, materials or components used in the practice of integrated beach umbrella and table systems, in addition to those not specifically recited, may be varied or otherwise particularly adapted to specific environments, manufacturing specifications, design parameters or other operating requirements without departing from the general principles of the same.

As used herein, the terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of integrated beach umbrella and table systems and their methods of manufacture described herein are, for example, capable of operation in sequences other than those illustrated or otherwise described herein.

The terms "left," "right," "top," "bottom," "front," "back," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of integrated beach umbrella and table systems and their methods of manufacture described herein are, for example, capable of operation in other orientations than those illustrated or otherwise described herein. The term "coupled," as used herein, is defined as directly or indirectly connected in a physical, mechanical, electrical, magnetic, or other manner.

What is claimed is:

1. An integrated umbrella and table system comprises:

a support post;

an expandable and collapsible umbrella support frame coupled to the support post;

an umbrella canopy coupled to the umbrella support frame;

an expandable and collapsible table surface support frame comprising a plurality of armature elements;

a central hub engaged to the support post and coupled to at least a portion of the plurality of armature elements;

an anchor hub engaged to the support post; affixed at a position to the support post, below the central hub, and coupled to the at least a portion of the plurality of armature elements;

wherein the central hub is configured to slide along the support post to produce a first expanded position of the table surface support frame and a second collapsed position of the table surface support frame; and a flexible table surface coupled to the table surface support frame and configured to collapse about the support post in the second collapsed position to enclose the table support frame.

2. The system of claim 1, wherein the support post separates into a support post first section and a support post second section, wherein the support post first section supports the umbrella support frame, and the support post second section supports the table surface support frame.

3. The system of claim 1, wherein the plurality of armature elements comprises;

a plurality of first armature elements; and a complimentary plurality of second armature elements;

wherein each of the plurality of first armature elements comprises a first armature first end pivotally coupled to the central hub;

wherein each of the plurality of second armature elements comprises a second armature first end pivotally coupled to the anchor hub;

wherein each of the plurality of second armature elements comprises a second armature second end pivotally coupled at a point along a length of its complimentary first armature element.

4. The system of claim 3, further comprising:

a channel that extends longitudinally along the support post;

a key that protrudes inwardly from an inner diameter of at least one of the central hub and the anchor hub; and wherein the key fits within the channel of the support post to inhibit torsional rotation of the at least one of the central hub and the anchor hub about the support post.

5. The system of claim 3, wherein each of the plurality of first armature elements further comprises a first armature telescopic portion expandable to accommodate varying sizes of flexible table surfaces.

6. The system of claim 3, wherein in the first expanded position, a first armature second end of each of the plurality of first armature elements is substantially co-planar with the central hub.

7. The system of claim 3, wherein the first armature second end of each of the plurality of first armature elements couples to a perimeter portion of the flexible table surface.

8. The system of claim 3, wherein the flexible table surface further comprises at least one of a cup holder and a storage bin.

9. The system of claim 8, further comprising an electronic device support frame to support at least one of a smart-phone, tablet, and video display.

10. The system of claim 9, wherein the umbrella canopy comprises solar cell elements to convert sunlight to a useable electrical current, and wherein the useable electrical current is transmitted via a suitable conduit to the electronic device support frame to provide electrical power for the at least one of the smart-phone, table, and video display.

11. A method for manufacturing an integrated beach umbrella and table system comprises:

providing a support post;

affixing an expandable and collapsible umbrella support frame to the support post;

assembling an umbrella canopy and coupling it to the umbrella support frame;

assembling a plurality of armature elements to provide an expandable and collapsible table surface support frame;

engaging a central hub to the support post and coupling it to at least a portion of the plurality of armature elements;

engaging an anchor hub to the support post; affixing at a position to the support post, below the central hub, and coupling it to the at least a portion of the plurality of armature elements;

wherein the central hub is configured to slide along the support post to produce a first expanded position of the table surface support frame, and a second collapsed position of the table surface support frame; and providing a flexible table surface to couple to the table surface support frame and configured to collapse about the support post in the second collapsed position to enclose the table support frame.

12. The method of claim 11, wherein assembling the plurality of armature elements comprises;

assembling a plurality of first armature elements; and assembling a complimentary plurality of second armature elements;

wherein assembling each of the plurality of first armature elements comprises pivotally affixing a first armature first end to the central hub;

wherein assembling each of the plurality of second armature elements comprises pivotally affixing a second armature first end to the anchor hub;

wherein assembling each of the plurality of second armature elements further comprises pivotally affixing a second armature second end at a point along a length of its complimentary first armature element.

13. The method of claim 12, further comprising:

forming a channel that extends longitudinally along the support post;

incorporating a key that protrudes inwardly from an inner diameter of at least one of the central hub and the anchor hub; and wherein the key is configured to fit within the channel of the support post to inhibit torsional rotation of the at least one of the central hub and the anchor hub about the support post.

14. The method of claim 12, wherein assembling each of the plurality of first armature elements further comprises assembling a first armature telescopic portion that may be expandable to accommodate varying sizes of flexible table surfaces.

15. The method of claim 11, wherein in the first expanded position, a first armature second end of each of the plurality of first armature elements is substantially co-planar with the central hub.

16. The method of claim 11, wherein the first armature second end of each of the plurality of first armature elements couples to a perimeter portion of the flexible table surface.

* * * * *